United States Patent [19]

Rodman

[11] 3,957,096

[45] May 18, 1976

[54] COMBINATION HAND TOOL

[76] Inventor: Victor W. Rodman, 8886 Phoenix Ave., Fair Oaks, Calif. 95628

[22] Filed: Apr. 28, 1975

[21] Appl. No.: 572,137

[52] U.S. Cl. ..... 145/50 R; 81/58.3; 145/61 EA; 145/61 L; 145/71; 145/76

[51] Int. Cl.[2] ..... B25B 15/04

[58] Field of Search ..... 145/50 R, 50 B, 61 R, 145/61 E, 61 EA, 61 G, 61 L, 66, 75, 76–77, 70, 71–74; 81/58.3

[56] References Cited

UNITED STATES PATENTS

| | | | |
|---|---|---|---|
| 994,804 | 6/1911 | Wahlstrom | 145/50 R |
| 1,049,650 | 1/1913 | Benjamin | 145/76 |
| 1,411,242 | 3/1922 | Faust | 145/61 L |
| 1,878,053 | 9/1932 | Winger | 145/76 UX |
| 2,292,228 | 8/1942 | Krieger | 145/76 |
| 2,544,736 | 3/1951 | Szekely | 145/50 R X |
| 3,332,304 | 7/1967 | Lynn | 81/58.3 X |
| 3,475,999 | 11/1969 | Roberts et al. | 145/71 |
| 3,651,718 | 3/1972 | Thomasian | 81/58.3 X |
| 3,797,546 | 3/1974 | McGee | 145/61 L |

FOREIGN PATENTS OR APPLICATIONS

| | | | |
|---|---|---|---|
| 50,635 | 4/1932 | Norway | 145/76 |
| 385,130 | 3/1965 | Switzerland | 145/61 EA |

*Primary Examiner*—Al Lawrence Smith
*Assistant Examiner*—J. T. Zatarga
*Attorney, Agent, or Firm*—Lothrop & West

[57] ABSTRACT

A hemispherical palm grip is rotatably mounted on one end of a shank. The other end of the shank carries a conventional ball detent adapted to engage a variety of tool heads, such as wrenches, screwdriver bits, chucks, sockets, twist drills and the like. By engaging the palm grip with the palm of one hand while exerting torque on the tool head, as by a ratchet wrench held in the other hand and engaging the shank, the shank is conveniently maintained in proper alignment with the piece being worked on, the shank being rotated by the ratchet handle while the palm grip remains stationary.

When less torque needs to be applied, the ratchet wrench can be dispensed with and the grips alone can be used. While holding the palm grip in the palm of the hand, the thumb and fingers are extended to engage a finger grip translatably mounted on a square in cross section portion of the shank, the finger grip being located adjacent the palm grip. By retracting the thumb and fingers the finger grip is biased toward and into clutching engagement with the palm grip. Torque applied to the palm grip and clutched finger grip is transferred to the square-in-section shank and thence to the tool head and work piece.

6 Claims, 4 Drawing Figures

17
12
33
57
42
78
76
74
81
48
54
56
18
27
28
26
29
22
23
32
31
16
14
13
53
4
19
21
44
46
43
45
47
36
34
39
41
37
38
58
59
51
62
61
71
49
63
64
66
67
68
72
52
79
77

COMBINATION HAND TOOL

BACKGROUND OF THE INVENTION

The market place and the patent literature are replete with hand tools possessing various special forms of handles to facilitate the application of torque to tool heads and tool pieces. Exemplary of U.S. patents in this field are Miller U.S. Pat. No. 3,508,455, dated Apr. 28, 1970, Ballsmith et al. U.S. Pat. No. 3,654,975, dated Apr. 11, 1972 and Whiteford U.S. Pat. No. 3,742,787 dated July 3, 1973.

There remains, however, considerable room for improvement.

SUMMARY OF THE INVENTION

The invention relates generally to auxiliary handles for tool shanks and, more particularly, to a handle which enables the user not only to maintain the shank in most effective alignment while large torque is applied, as by a ratchet wrench, but also to apply rotative force directly to the shank when less torque will suffice and to exert translational force, when required, in the direction of the tool head and work piece.

It is an object of the invention to provide a combination hand tool which is compact in size, light in weight and smooth in exterior configuration for ease and comfort of use.

It is another object of the invention to provide a combination hand tool which is relatively economical, yet is rugged, has but few moving parts to get out of order, and is long-lived.

It is a further object of the invention to provide a combination hand tool which is versatile in that it can be used in a wide variety of situations requiring the application of torque of various magnitudes to a work piece and the imposition of axial force on the work piece.

It is another object of the invention to provide a generally improved combination hand tool.

Other objects, together with the foregoing, are attained in the embodiment described in the following description and illustrated in the accompanying drawing.

DETAILED DESCRIPTION OF THE PREFERRED EMBODIMENT ILLUSTRATED

Figures 1, 2, 3, 4:
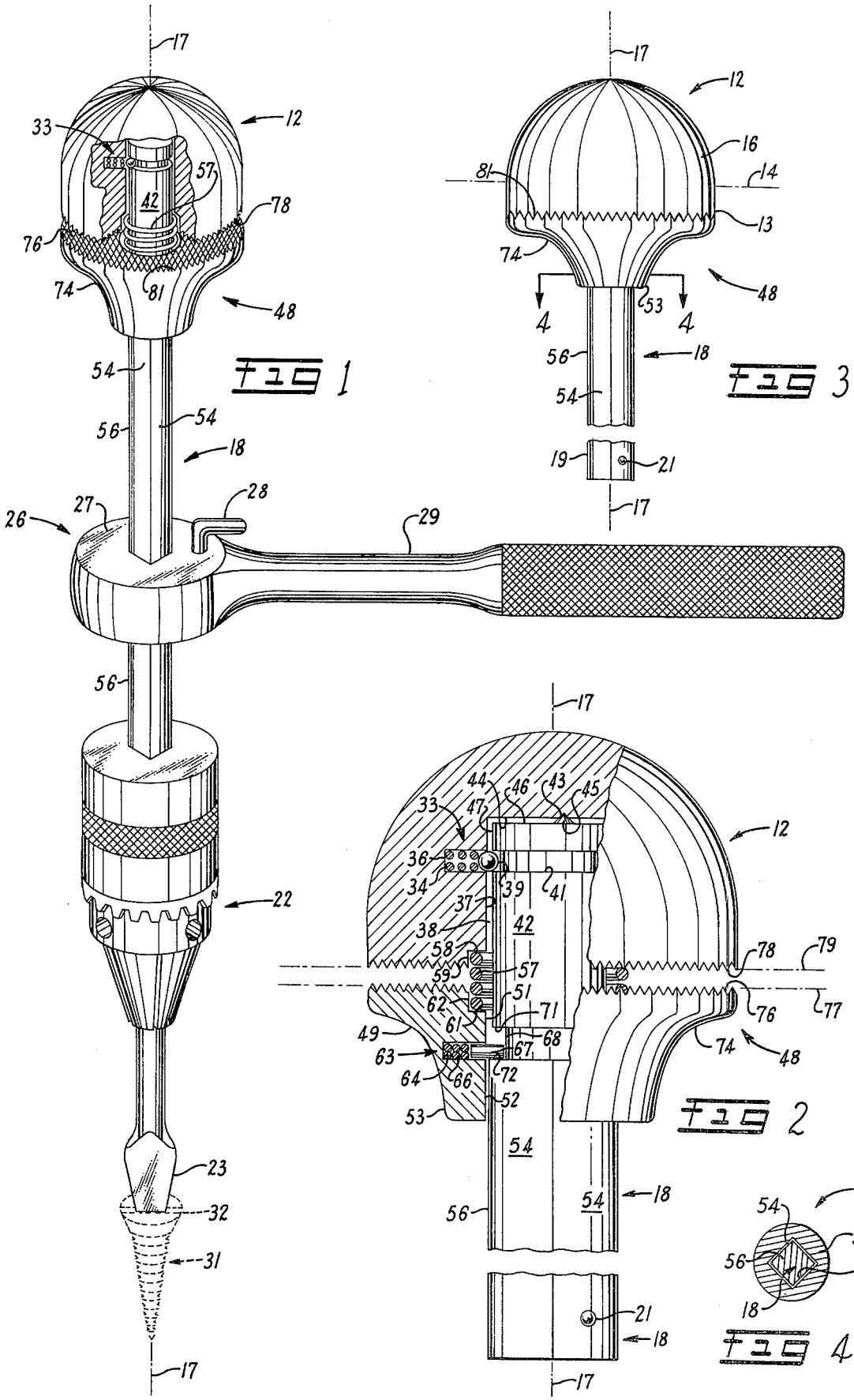
FIG. 1 is an oblique view showing the tool as used in conjunction with a chuck holding a screwdriver bit and a ratchet wrench for providing large torque, a portion of the palm grip being broken away to reveal interior details.
FIG. 2 is a fragmentary side elevational view to an enlarged scale, showing the finger grip separated from the palm grip, with portions of both grips broken away to disclose internal structural details.
FIG. 3 is a fragmentary side elevational view showing the finger grip in clutched relation to the palm grip, as the tool appears when torque is being applied by the user's hand directly to the two grips, thence to the shank; and, FIG. 4 is a sectional view taken on the line 4—4 in FIG. 3.

The combination hand tool of the invention, generally designated by the reference numeral 11, includes a palm grip 12 which is generally hemispherical but which also includes a short right circular cylindrical portion 13 extending downwardly from the plane 14 of the equator of the hemisphere 16, the cylindrical portion 13 and the hemisphere 16 sharing a common axis 17.

The palm grip 12 can be constructed of metal or of high impact synthetic resinous material, or the like.

Also aligned on the axis 17 is an elongated tool shank 18 provided at its distal end 19 with a conventional ball detent 21 engageable, in well known fashion, with a great variety of tool heads 22, such as a chuck holding a screwdriver bit 23, as shown in FIG. 1.

When large torque is required to operate the tool head, a wrench 26 is often utilized. Conveniently, the wrench 26 is provided with a ratchet mechanism (not shown) inside the wrench head 27 engaging the shank 18. A lever 28 on the head 27 is capable of reversing the direction of effective torque application so that the handle 29 can be maneuvered to apply torque to the shank 18 in either angular direction.

When a tool head, such as the screwdriver bit 23, is engaging a work piece, such as a screw 31, shown in broken line, it is often very helpful for the user to be able to maintain the axis 17 of the tool and the tool head 22 in alignment with the axis of the work piece 31 and to exert an axial force on the work piece at the same time.

By placing the palm of the left hand, for example, on the palm grip 12 while manipulating the ratchet handle 29 with the right hand, not only can an axial force be applied to the tool head 22 so that the bit 23 securely engages the screw slot 32, but the attitude, or posture, of the axis 17 of the shank 18 can easily be kept in proper alignment with respect to the axis of rotation of the work piece 31.

Despite the axial force exerted on the shank 18 and despite the rotation of the shank as the ratchet handle 29 is operated, the palm grip 12 remains stationary. Relative rotation without translation is attained by the use of a conventional ball detent mechanism 33 including a spring 34 within a lateral blind hole 36 in the wall 37 of a blind axial bore 38 in the palm grip 12.

The spring 34 biases a ball 39 inwardly so that the ball protrudes partially into an annular recess 41 formed in the proximal end portion 42 of the shank 18.

The proximal end portion 42 of the shank is circular in cross section, the right circular cylindrical portion 42 extending into the blind axial bore 38 with a centering hole 43 in the bore end 44 engaged by a centering dimple 45 on the end flat 46 of the shank 18.

As most clearly appears in FIG. 2, sufficient clearance is provided between the side wall 47 of the cylinder 42 and the blind bore walls 37 so that relative rotation is afforded. The clearance between the end flat 46 of the shank and the adjacent bore end 44 would, in practice, not ordinarily exist since, with the help of a suitable lubricant, the end flat 46 would serve effectively as a thrust bearing when axial force is exerted on the palm grip 12. Axial force is often required, for example, during a drilling and tapping operation, or to keep the bit 23 in the slot 32 and exert an axial urgency on the screw 31 in the direction of screw travel.

In many situations it is not necessary to apply the large torque made available by the ratchet handle 29. In these cases, the wrench 26 can be dispensed with and the necessary torque provided by rotating the hemispherical palm grip 12, which, in addition to being comfortable, affords a very substantial moment arm.

In order to transfer torque from the palm grip 12, which, in an unclutched mode, is rotatable relative to the shank 18, there is provided a clutch member 48, or finger grip, adjacent to and spaced from the palm grip 12 in the unclutched mode.

The portion 49 of the finger grip 48 closest to the palm grip 12 is provided with an axial, circular in cross section opening 51 loosely encompassing the cylindrical portion 42 of the shank 18.

However, as appears most clearly in FIG. 4, the axial opening 52 in the portion 53 of the finger grip 48 farthest removed from the palm grip 12 is square in cross section, and the walls of the square opening 52 are in sliding engagement with the four walls 54 of the square in cross section portion 56 of the shank 18. Relative translational movement between the finger grip 48 and the shank 18 is thereby afforded, but not relative rotation.

Biasing the finger grip 48 away from the palm grip 12 is a compression spring 57 bearing at one end against a shoulder 58 formed by an annular recess 59 in the palm grip 12 and bearing at the other end against a shoulder 61 formed by an annular recess 62 in the finger grip 48.

The extent of maximum separation of the palm grip 12 and the finger grip 48 in unclutched mode is determined by the location and dimensions of a limit stop mechanism 63 including a compression spring 64 disposed within a lateral blind hole 66 and a detent pin 67 urged inwardly by the spring 64 into an opening 68 formed in the shank 18. Although the opening 68 as appears in FIG. 2 is annular in configuration, for ease in assembly, it is to be recognized that the detent pin 67 could operate merely within a longitudinal recess in the adjacent wall of the shank 18.

In either event, the longitudinal length of the opening 68 determines the maximum extent of translational movement of the finger grip, it being noted, however, that in actual practice, the longitudinal placement of the opening is such that in clutched mode, the detent pin 67 is slightly spaced from the upper shoulder 71 of the opening 68 as seen in FIG. 2.

In unclutched mode, on the other hand, the detent pin 67 engages the lower shoulder 72, as appears in FIG. 2, and thereby limits the extent to which the finger grip 48 can travel away from the palm grip under urgency of the biasing spring 57.

The exterior contours of the finger grip 48 are arranged and dimensioned so that when the average user's hand covers the palm grip 12, and the thumb and four fingers are first extended substantially parallel to the axis 17 and then curled inwardly, the ends of the thumb and fingers naturally and comfortably fit into the concave surface of revolution 74. Then, as the ends of the thumb and fingers are firmly retracted in the direction of the palm, the supervening axial component of the force exerted on the finger grip 48 is effective to overcome the opposing force of the biasing spring 57 and place the two grips 12 and 48 in clutching mode.

That is to say, by urging the finger grip 48 from the first, separated position, shown in FIGS. 1 and 2, into the second unseparated position, illustrated in FIG. 3, the annular surface 76 of the finger grip 48 lying in the transverse plane 77 is brought into tight face to face engagement with the adjacent annular surface 78 of the palm grip 12 lying in the transverse plane 79.

Preferably, the respective surfaces 76 and 78 are constructed of a material which provides a high friction factor and is also durable. In fact, as illustrated herein, the surfaces are mechanically roughened, as by scoring 81, so that physical interdentation is established, thereby providing a positive drive between the clutch faces 76 and 78.

By clutching the finger grip 48 to the palm grip 12, torque applied to the palm grip 12 is transmitted through the clutch member 48 to the square walls 54 of the shank 18, thence to the tool head 22 and work piece 31. At the same time, axial force can be applied, if desired, in the direction of the piece being worked on.

When the job is completed, the thumb and fingers can be opened, allowing the biasing spring 57 to release the clutch 48 which moves axially until limited by abutment of the detent pin 67 against the shoulder 72, as appears most clearly in FIG. 2, ready for use on the next job.

What is claimed is:

1. A combination hand tool comprising:

a. an elongated shank having a ball detent mounted on one end to receive a variety of torque-operated tool heads;

b. a palm grip rotatably mounted on the other end of said shank;

c. a finger grip mounted on said shank intermediate said ends for limited translational movement along said shank between a first position spaced from said palm grip and a second position in engagement with said palm grip, the distance between said palm grip and said finger grip in said first position of said finger grip enabling the user to engage said finger grip with the thumb and fingers of one hand while engaging said palm grip with the palm of the same hand;

d. means connecting said finger grip and said shank for transmitting torque from said finger grip to said shank;

e. spring means mounted on said tool for biasing said finger grip toward said first position with a predetermined force, the user's said thumb and fingers being effective to engage said finger grip, when the palm of said hand is located on said palm grip, and to urge said finger grip from said first position toward said second position in opposition to said predetermined force; and, f. clutch means for engaging said palm grip and said finger grip in said second position of said finger grip, said clutch means including clutch faces on said palm grip and on said finger grip effective to transfer torque from said palm grip to said finger grip in either opposite angular direction when said finger grip is in said second position.

2. A combination hand tool as in claim 1 in which said torque transmitting means including a square in cross section portion of said shank in the vicinity of said finger grip, and said finger grip includes an opening which is square in cross section, the walls of said square opening being large enough to engage and rotate said square in cross section portion of said shank when torque is applied to said finger grip.

3. A combination hand tool as in claim 2 including a first detent member carried on said finger grip, said first detent member protruding into a longitudinally elongated recess in a side of said shank, said detent member abutting with a shoulder defining the end of said recess farthest removed from said palm grip and providing a stop limiting the extent of movement of said finger grip away from said palm grip.

4. A combination hand tool as in claim 3 in which said palm grip is substantially hemispherical in shape and includes a blind axial bore, and in which said shank in the vicinity of said palm grip is circular in cross section and fits loosely in said bore for relative rotation between said palm grip and said shank.

5. A combination hand tool as in claim 4 including a second detent member carried on the wall of said blind axial bore and protruding into an annular recess in said shank to allow relative rotation between said shank and said palm grip and prevent relative translation therebetween.

6. A combination hand tool as in claim 1 wherein said clutch means includes an annular surface on said palm grip facing toward said finger grip and an annular surface on said finger grip facing toward said palm grip, and wherein both of said annular surfaces are roughened with physical interdentations in order clutchingly to engage said palm grip and to provide a positive drive from said palm grip to said finger grip in said either opposite angular direction when said finger grip is in said second position.

* * * * *